US006722948B1

(12) United States Patent
Berman

(10) Patent No.: US 6,722,948 B1
(45) Date of Patent: Apr. 20, 2004

(54) PAD CONDITIONING MONITOR

(75) Inventor: Michael J. Berman, West Linn, OR (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 10/423,096

(22) Filed: Apr. 25, 2003

(51) Int. Cl.[7] ..... B24B 49/18

(52) U.S. Cl. ..... 451/21; 451/6; 451/10; 451/11; 451/56

(58) Field of Search ..... 451/56, 443, 444, 451/7, 6, 10, 11, 21, 17

(56) References Cited

U.S. PATENT DOCUMENTS 5,749,772 A * 5/1998 Shimokawa ..... 451/53
5,827,112 A * 10/1998 Ball ..... 451/21
6,343,974 B1 * 2/2002 Fran.cedilla.a et al. ..... 451/9
6,402,597 B1 * 6/2002 Sakurai et al. ..... 451/56
6,517,414 B1 * 2/2003 Tobin et al. ..... 451/8
2003/0013394 A1 * 1/2003 Choi et al. ..... 451/443

* cited by examiner

*Primary Examiner*—George Nguyen
(74) *Attorney, Agent, or Firm*—Luedeka, Neely & Graham, P.C.

(57) ABSTRACT

A modification to a chemical mechanical polishing conditioner of a type having a member with a conditioning surface adapted to apply a force to and condition a polishing pad. The conditioner includes at least one sensor disposed within the member, where the at least one sensor is adapted to sense at least one of an amount of the force applied to the polishing pad and a uniformity across the member of the force applied to the polishing pad. In this manner, the force applied by the conditioner to the pad, and the uniformity of the force applied by the conditioner to the pad, can be sensed. These sensed forces can be monitored, reported, and controlled, thus providing a better controlled chemical mechanical polishing process.

20 Claims, 1 Drawing Sheet

PAD CONDITIONING MONITOR

FIELD

This invention relates to the field of integrated circuit fabrication. More particularly, this invention relates to improving the uniformity and other process characteristics of chemical mechanical polishing.

BACKGROUND

As integrated circuits have become smaller, they have shrunk not only in the amount of surface area required, but also in the thicknesses of the various layers by which they are formed. As the thicknesses of the layers has decreased, it has become increasingly important to planarize a given layer prior to forming a subsequent overlying layer. One of the methods used for such planarization is called chemical mechanical polishing. During chemical mechanical polishing, the surface of the layer to be planarized, thinned, or both is brought into contact with the surface of a polishing pad. The pad and the substrate are rotated and translated relative to each other in the presence of a polishing fluid, which typically contains both physical erosion particles and chemical erosion compounds. Because of the thinness of the layers and the tight tolerances desired, it is important to have a relatively high degree of control over the chemical mechanical polishing process.

One method by which control of the chemical mechanical polishing process is maintained is called conditioning. During conditioning, an implement called a conditioner is brought into contact with the surface of the pad. The conditioner is intended to erode the surface of the pad, so as to expose a portion of the pad that is presumptively more uniform and clean. Conditioning the pad may be accomplished either between substrate polishing processes, or concurrently with the polishing process. Conditioning tends to generally improve important process characteristics such as substrate to substrate repeatability, polish rate stability, pad life, down time, and overall cost of system ownership.

Because the conditioner performs such an important function, it is commensurately important to ensure that the conditioner is functioning properly. Such methods have in the past included a visual inspection of the conditioner, a "fish scale" force monitor, removing the conditioner and performing a flatness test against a known flat standard, and regularly rebuilding or replacing the conditioner. If the conditioner is miss-aligned, worn out, or warped, then it might not make complete and uniform contact with the pad. Such poor pad conditioning might result in poor processing uniformity across a substrate or from substrate to substrate, shorter pad life, increased down time, and other expenses due to yield loss.

Unfortunately, it is very difficult to detect whether the pad conditioner is performing properly, except by the dramatic indicators given above, such as short pad life and wafer non uniformity. Thus, in an extreme condition, a pad conditioner may need to be removed and completely set up anew each day, to ensure that it is in good condition and operating properly. However, this is an expensive and time-consuming process, and opens the door for mistakes to be made during the frequently repeated set up process.

What is needed, therefore, is a system by which proper operation of the pad conditioner can be more readily determined.

SUMMARY

The above and other needs are met by a modification to a chemical mechanical polishing conditioner of a type having a member with a conditioning surface adapted to apply a force to and condition a polishing pad. The conditioner includes at least one sensor disposed within the member, where the at least one sensor is adapted to sense at least one of an amount of the force applied to the polishing pad and a uniformity across the member of the force applied to the polishing pad.

In this manner, the force applied by the conditioner to the pad, and the uniformity of the force applied by the conditioner to the pad, can be sensed. In various preferred embodiments these sensed forces can be monitored, reported, and controlled, thus providing a better controlled chemical mechanical polishing process.

Preferably a controller receives signals from the at least one sensor and reports at least one of the amount of the force applied to the polishing pad and the uniformity across the member of the force applied to the polishing pad in response to the signals received from the at least one sensor. At least one pressure adjustment zone is preferably disposed along a lower edge of the member, and a controller receives signals from the at least one sensor and sends signals to the at least one pressure adjustment zone to adjust at least one of the amount of the force applied to the polishing pad and the uniformity across the member of the force applied to the polishing pad.

The at least one sensor may include strain gauges disposed along an upper edge of the member and a pressure sensor disposed along a lower edge of the member. Further, the at least one sensor may be a multi-zone pressure sensor or a plurality of pressure sensors disposed along a lower edge of the member. The member preferably includes a rigid member and a conditioning pad wrapped around a lower edge of the rigid member, where the at least one sensor is disposed between the lower edge of the rigid member and the conditioning pad.

According to another aspect of the invention there is described a chemical mechanical polisher including the conditioner described herein.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
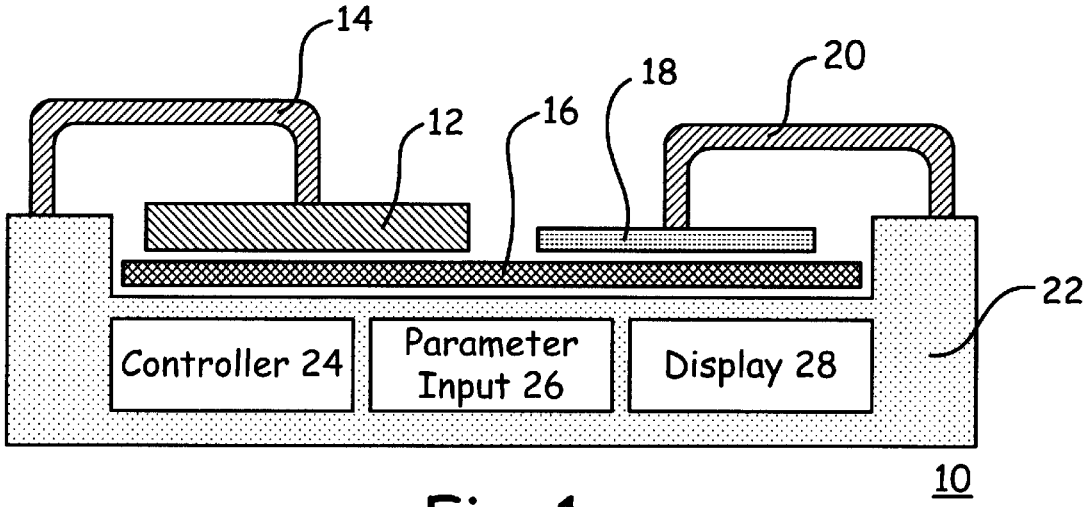
FIG. 1 is a functional schematic of a chemical mechanical polisher according to the present invention, including a conditioner.

With reference now to FIG. 1, there is depicted a functional schematic of a chemical mechanical polisher 10 according to the present invention, including a conditioner 12. The conditioner 12 abrades the surface of a rotating polishing pad 16 in a controlled manner, thus conditioning the polishing pad 16. The conditioner 12 is forced against the pad 16 such as by an armature 14, which preferably sweeps the conditioner 12 across the surface of the pad 16. A substrate 18 is polished against the pad 16, under the control of an effecter 20. The polishing of the substrate 18 may be either concurrent or alternating with the use of the conditioner 12.

The conditioner 12 may be formed in any one of a number of different configurations. For example, in one embodiment the conditioner 12 is formed in the shape of a bar. In alternate embodiments, the conditioner 12 is formed in a disk shape. The disk shape of the conditioner 12 may be either solid or hollow, in the form of a hollow circular member. The conditioner may take other shapes as well, such as other geometrically shaped surface areas. It is appreciated that the conditioner 12 may also be formed in various sizes, such as the size presented in FIG. 1, where it is about half of the diameter of the polishing pad, or in larger or smaller sizes. Thus, the embodiments as depicted in the figures are representative only in regard to the exact shape and size of the conditioner 12.

A housing 22 contains mechanical and electrical controls for the polisher 10, which preferably operates under the control of a controller 24. An operator can input commands and other parameters into the polisher 10 such as by the input 26. Information in regard to the processing is preferably presented on the display 28. One or more of the controller 24, input 26, and display 28 may be either located within the housing 22 of the system 10 as depicted in FIG. 1, or may be remotely connected to the main unit 22, such as by a computer network.

As mentioned above, it is desirable to condition the pad 16 with the conditioner 12 in a uniform and well controlled manner. Thus, it is desirable to engage the conditioner 12 against the surface of the pad 16 with a known and repeatable force, and also with a force that is known and preferably uniform across the conditioner 12. Because of the conditions mentioned above, the knowledge and control of such forces is typically not easily had.

Figure 2:
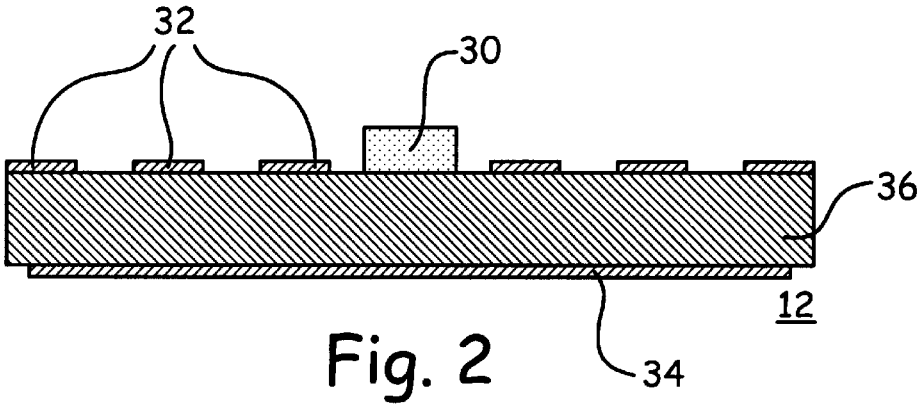
FIG. 2 is a side view of a conditioner according to the present invention.

FIG. 2 is a side view of the conditioner 12, depicting a pivot point 30 by which the conditioner 12 is preferably attached to the armature 14. A rigid member 36 preferably forms the structural portions of the conditioner 12. The rigid member 36 is preferably formed of a relatively rigid material, such as a metal, hard thermoset plastic, or ceramic material. There is preferably at least one sensor disposed on the conditioner 12, which at least one sensor is adapted to sense at least one of an amount of the force applied to the polishing pad and a uniformity across the conditioner 12 of the force applied to the polishing pad 16. In FIG. 2, several different sensors are depicted, which sensors are of at least two different types.

Disposed along an upper edge of the conditioner 12 as depicted in FIG. 2 are stain gauges 32. In the example depicted in FIG. 2, there are six strain gauges disposed across the rigid member 36. However, in alternate embodiments there may be either a greater or a lesser number of strain gauges 32 so disposed. The strain gauges 32 measure the uniformity of the force applied by the armature 14 through the conditioner 12 to the pad 16 by measuring deflections across the rigid member 36. Thus, by sensing these deflections, an understanding of the distribution and uniformity of the force applied to the pad 16 by the conditioner 12 can be had.

Disposed along the bottom edge of the rigid member 36 there is depicted a pressure sensor 34. The pressure sensor 34 is able to measure a total amount of force that is applied through the conditioner 12 to the pad 16. Further, if the pressure sensor 34 is a plurality of pressure sensors 34 disposed along the bottom edge of the member 36, or if the pressure sensor 34 is a multi segmented pressure sensor 34, then the force applied at various positions across the rigid member 12 can be sensed and reported. Such a pressure sensor 34 can be acquired from Pressure Profile Systems, Inc. of Los Angeles, Calif., such as their P-2000 Flexible Strip System.

The sensors, whether they be strain gauges 32, pressure sensor(s) 34, another type of sensor, or a combination of any two or more of those mentioned, preferably provide signals to the controller 24, which signals contain information in regard to the force applied to the pad 16 and the distribution or uniformity of that applied force. The controller 24 is preferably adapted to display such information on the display 28. In addition, the controller 24 is preferably programmable, such as through the input 26, to control the amount of force applied through the conditioner 12. Such control can be accomplished such as by applying more or less force, as desired, through the armature 14.

Figure 3:
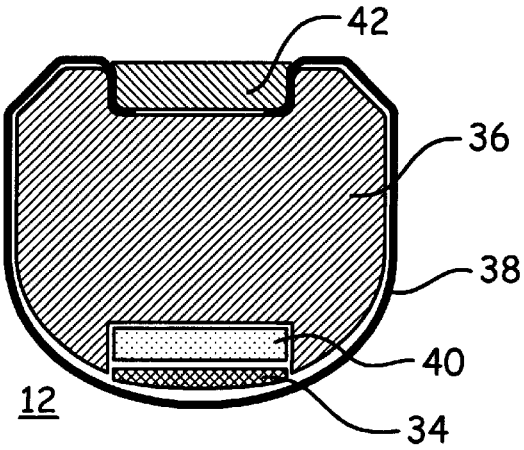
FIG. 3 is a cross sectional view of the conditioner according to the present invention.

FIG. 3 depicts a cross sectional view of the conditioner 12, which includes an additional example of a method by which the force applied through the conditioner 12 to the pad 16 can be controlled. The rigid member 36 is most preferably clad with a conditioning pad 38, such as a diamond impregnated pad, which is the portion of the conditioner 12 which contacts the pad 16. The pad 38 is preferably retained against the rigid member 36 such as with a retaining block 42, which is releasably affixed to the member 36.

As depicted in FIG. 3, the pressure sensor 34 is preferably disposed at the bottom edge of the rigid member 36, where it can sense the force that is applied between the rigid member 36 and the pad 16. Most preferably, there is also a selectively formable piece 40 disposed adjacent the pressure sensor 34, which selectively formable piece 40 is operable to selectively expand and contract, thus selectively increasing and decreasing the pressure in a specific location across the rigid member 36.

Most preferably, there is a separately controlled selectively formable piece 40 disposed adjacent each section of a multi segmented pressure sensor 34 across the rigid member 36, so that the pressure in each of the sections can be independently sensed by the sensors, reported to the controller 24, and controlled by the selectively formable piece 40 as desired. In this manner, the uniformity of the force that is applied across the conditioner 12 can be known and controlled. With such capabilities, the conditioner 12 can be programmed to apply different forces, with different uniformity profiles, for different polishing processes, such as may be dependent upon the nature of the material of the layer to be planarized on the substrate 18.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. In a chemical mechanical polishing conditioner of a type having a member with a conditioning surface adapted to apply a force to and condition a polishing pad, the improvement comprising at least one sensor disposed within the member, the at least one sensor adapted to sense at least one of an amount of the force applied to the polishing pad and a uniformity across the member of the force applied to the polishing pad.

2. The chemical mechanical polishing conditioner of claim 1, further comprising a controller for receiving signals from the at least one sensor and reporting at least one of the amount of the force applied to the polishing pad and the uniformity across the member of the force applied to the polishing pad in response to the signals received from the at least one sensor.

3. The chemical mechanical polishing conditioner of claim 1, further comprising at least one pressure adjustment zone disposed along a lower edge of the member, and a controller for receiving signals from the at least one sensor and sending signals to the at least one pressure adjustment zone to adjust at least one of the amount of the force applied to the polishing pad and the uniformity across the member of the force applied to the polishing pad.

4. The chemical mechanical polishing conditioner of claim 1, wherein the at least one sensor comprises strain gauges disposed along an upper edge of the member.

5. The chemical mechanical polishing conditioner of claim 1, wherein the at least one sensor comprises a pressure sensor disposed along a lower edge of the member.

6. The chemical mechanical polishing conditioner of claim 1, wherein the at least one sensor comprises a multi-zone pressure sensor disposed along a lower edge of the member.

7. The chemical mechanical polishing conditioner of claim 1, wherein the at least one sensor comprises a plurality of pressure sensors disposed along a lower edge of the member.

8. The chemical mechanical polishing conditioner of claim 1, wherein the member includes a rigid member and a conditioning pad wrapped around a lower edge of the rigid member, where the at least one sensor is disposed between the lower edge of the rigid member and the conditioning pad.

9. In a chemical mechanical polisher having a conditioner of a type having a member with a conditioning surface adapted to apply a force to and condition a polishing pad, the improvement comprising at least one sensor disposed within the member, the at least one sensor adapted to sense at least one of an amount of the force applied to the polishing pad and a uniformity across the member of the force applied to the polishing pad.

10. The chemical mechanical polisher of claim 9, further comprising a controller for receiving signals from the at least one sensor and reporting at least one of the amount of the force applied to the polishing pad and the uniformity across the member of the force applied to the polishing pad in response to the signals received from the at least one sensor.

11. The chemical mechanical polisher of claim 9, further comprising at least one pressure adjustment zone disposed along a lower edge of the member, and a controller for receiving signals from the at least one sensor and sending signals to the at least one pressure adjustment zone to adjust at least one of the amount of the force applied to the polishing pad and the uniformity across the member of the force applied to the polishing pad.

12. The chemical mechanical polisher of claim 9, wherein the at least one sensor comprises strain gauges disposed along an upper edge of the member.

13. The chemical mechanical polisher of claim 9, wherein the at least one sensor comprises a pressure sensor disposed along a lower edge of the member.

14. The chemical mechanical polisher of claim 9, wherein the at least one sensor comprises a multi-zone pressure sensor disposed along a lower edge of the member.

15. The chemical mechanical polisher of claim 9, wherein the at least one sensor comprises a plurality of pressure sensors disposed along a lower edge of the member.

16. The chemical mechanical polisher of claim 9, wherein the member includes a rigid member and a conditioning pad wrapped around a lower edge of the rigid member, where the at least one sensor is disposed between the lower edge of the rigid member and the conditioning pad.

17. In a chemical mechanical polishing conditioner of a type having a member, wherein the member includes a rigid member and a conditioning pad wrapped around a lower edge of the rigid member, the conditioning pad adapted to apply a force to and condition a polishing pad, the improvement comprising at least one sensor disposed between the lower edge of the rigid member and the conditioning pad, the at least one sensor adapted to sense at least one of an amount of the force applied to the polishing pad and a uniformity across the member of the force applied to the polishing pad.

18. The chemical mechanical polishing conditioner of claim 17, further comprising a controller for receiving signals from the at least one sensor and reporting at least one of the amount of the force applied to the polishing pad and the uniformity across the member of the force applied to the polishing pad in response to the signals received from the at least one sensor.

19. The chemical mechanical polishing conditioner of claim 17, further comprising at least one pressure adjustment zone disposed along the lower edge of the member, and a controller for receiving signals from the at least one sensor and sending signals to the at least one pressure adjustment zone to adjust at least one of the amount of the force applied to the polishing pad and the uniformity across the member of the force applied to the polishing pad.

20. The chemical mechanical polishing conditioner of claim 17, wherein the at least one sensor comprises a multi-zone pressure sensor disposed along the lower edge of the member.

* * * * *